US006575650B1

(12) United States Patent
Hu

(10) Patent No.: US 6,575,650 B1
(45) Date of Patent: Jun. 10, 2003

(54) PRESSURE SENSED INK-FILLED PEN

(75) Inventor: Cho-Kai Hu, Taipei (TW)

(73) Assignee: Pro Eton Corporation, Taipei (TW)

( * ) Notice: Subject to any disclaimer, the term of this patent is extended or adjusted under 35 U.S.C. 154(b) by 0 days.

(21) Appl. No.: 10/303,890

(22) Filed: Nov. 26, 2002

(51) Int. Cl.[7] ..... B43K 5/00
(52) U.S. Cl. ..... 401/206; 401/148
(58) Field of Search ..... 401/206, 205, 401/196, 148, 264, 263, 272, 273

(56) References Cited

U.S. PATENT DOCUMENTS 5,332,326 A * 7/1994 Hori ..... 401/148
5,676,481 A * 10/1997 Nicoll et al. ..... 401/148
6,004,058 A * 12/1999 Nicoll ..... 401/206
6,027,274 A * 2/2000 Seddon et al. ..... 401/206

* cited by examiner

*Primary Examiner*—David J. Walczak
*Assistant Examiner*—Huyen Le
(74) *Attorney, Agent, or Firm*—Bacon & Thomas, PLLC

(57) ABSTRACT

A pressure-sensed ink-filled pen comprises at least a pen tube, a valve, a filler seat and a filler. An ink outlet is formed within the front portion of the pen tube. An U-shape valve made of a relatively soft material is mounted in front of the ink outlet. A filler seat embedding a filler at the front end thereof is received in a flexible relation within the front portion of the pen tube, allowing a longitudinal movement. By pressing the filler and the filler seat at one end to cause another end to open the valve, a pressure-sensed ink-filled pen with proper ink supply is formed.

10 Claims, 6 Drawing Sheets

PRESSURE SENSED INK-FILLED PEN

BACKGROUND OF THE INVENTION (a) Field of the Invention

The invention relates to pressure sensed ink-filled pen and more particularly to a structural improved pen with pen tube filled with ink for the filler to absorb, by which proper measure of ink is supplied to avoid waste of ink and leads to structural simplification and reduction of cost.

(b) Description of the Prior Art

One type of conventional ink-filled pen has ink filled in pen tube for the filler to absorb. The prior art usually plant the filler at the front end of pen tube to absorb ink within. However, such model makes the filler absorb ink extravagantly and easily leads to fast running out of ink, crumpled and ragged paper while exceeded ink smear over paper, and also makes ink hard to dry.

So another model of ink-filled pen with a mechanism to adjust the supply of ink to fix said disadvantages could be found in the market. However, such commonly seen ink-supply-controlled pen generally has lots of components installed at the inner front end of pen tube, therefore makes overall structure of pen complicated. It does not only lead to tedious fabrication procedure but also the difficulties to cut down manufacturing cost.

SUMMARY OF THE INVENTION

The purpose of the invention is to provide a pressure sensed ink-filled pen model comprising at least one pen tube, one valve, one filler seat, and one filler with one ink outlet installed inside the front end of said pen tube, and said U shaped soft material valve installed covering upon the front of said ink outlet inside the front end of said pen tube, by which said filler seat at the front of said pen tube with said filler pivoted constitute one pressure sensed ink-filled pen so that by pushing said filler seat and said filler, said valve could be pushed open to ensure proper measure supplement of ink. Accordingly waste of ink could be avoided and the manufacturing cost could be cut down.

The secondary purpose of the invention is to provide a pressure sensed ink-filled pen model with an end cover installed at the rear end of said pen tube by which ink within said pen tube is sealed up.

Another purpose of the invention is to provide a pressure sensed ink-filled pen model such that at the front end of the end cover a longer hollow inserting section is installed extending into the pen tube in the front, by which at the front end of said inserting section an inner stopper could be installed to reduce the space within said pen tube therefore the deposition of ink can be controlled.

DETAILED DESCRIPTION OF THE PREFERRED EMBODIMENTS

Figure 1:
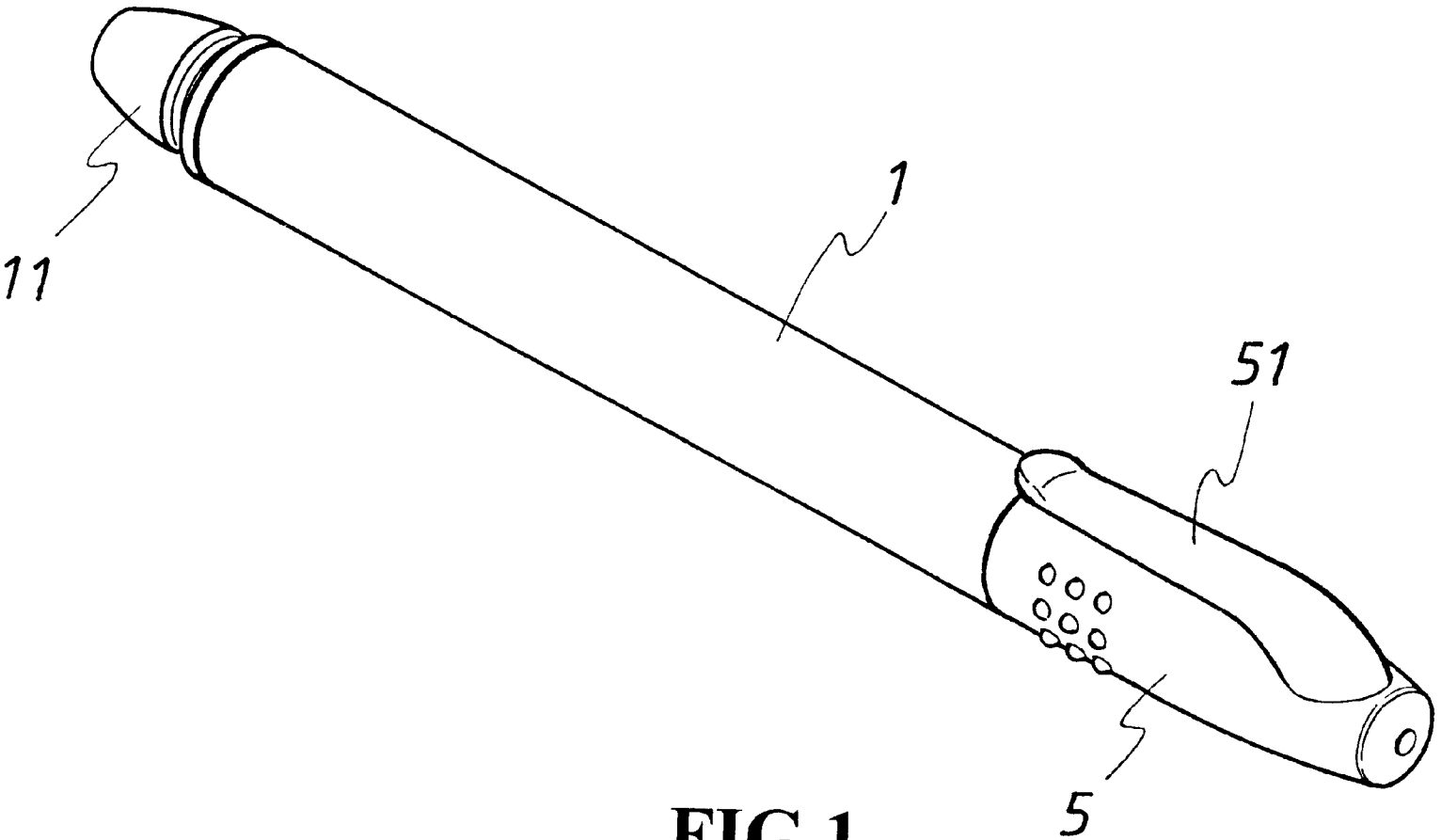
FIG. 1 is the exterior view illustrating the comprising parts of the invention.
Figure 2:
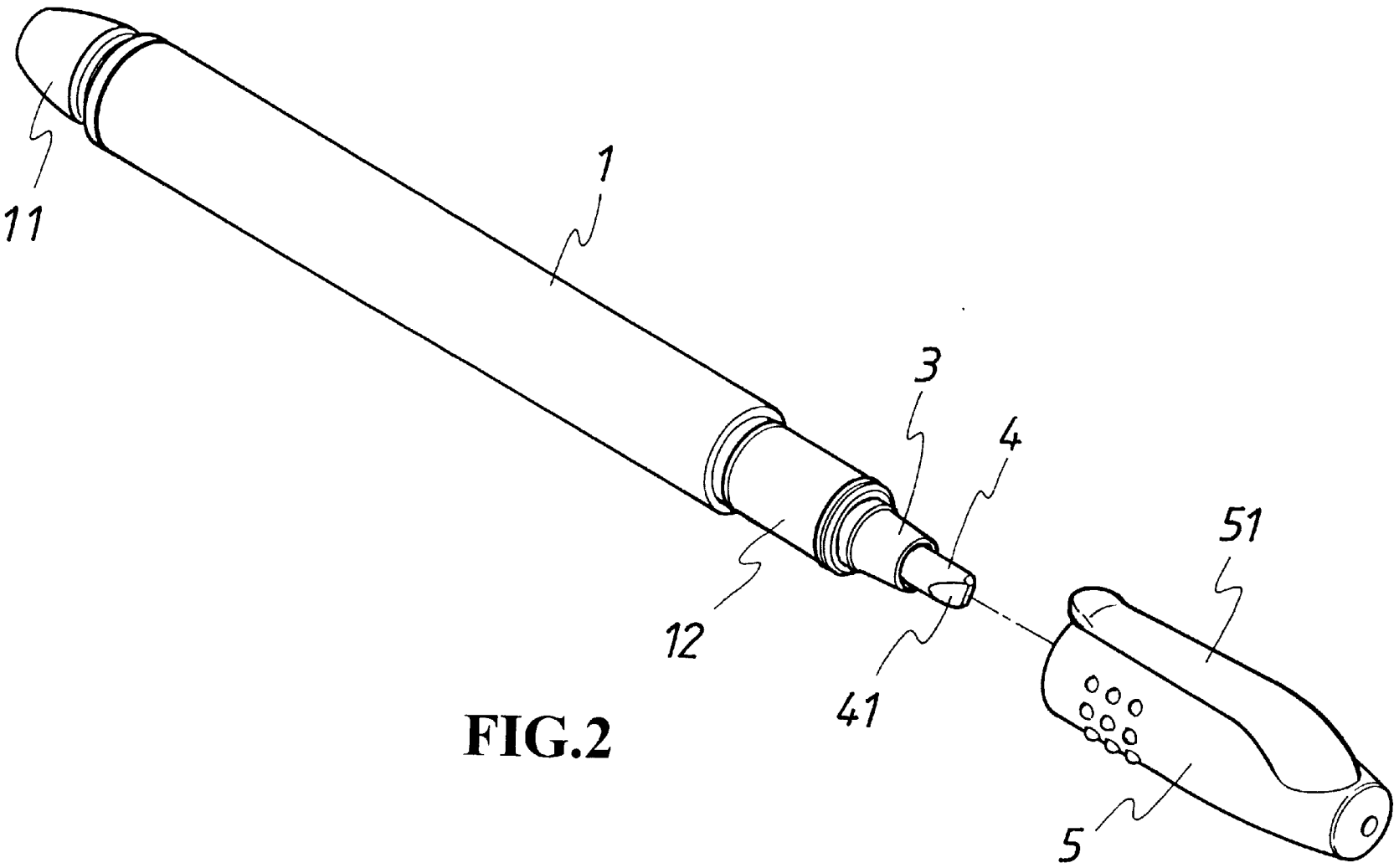
FIG. 2 is the exterior view illustrating the status with the pen cover separated from the pen.
Figure 3:
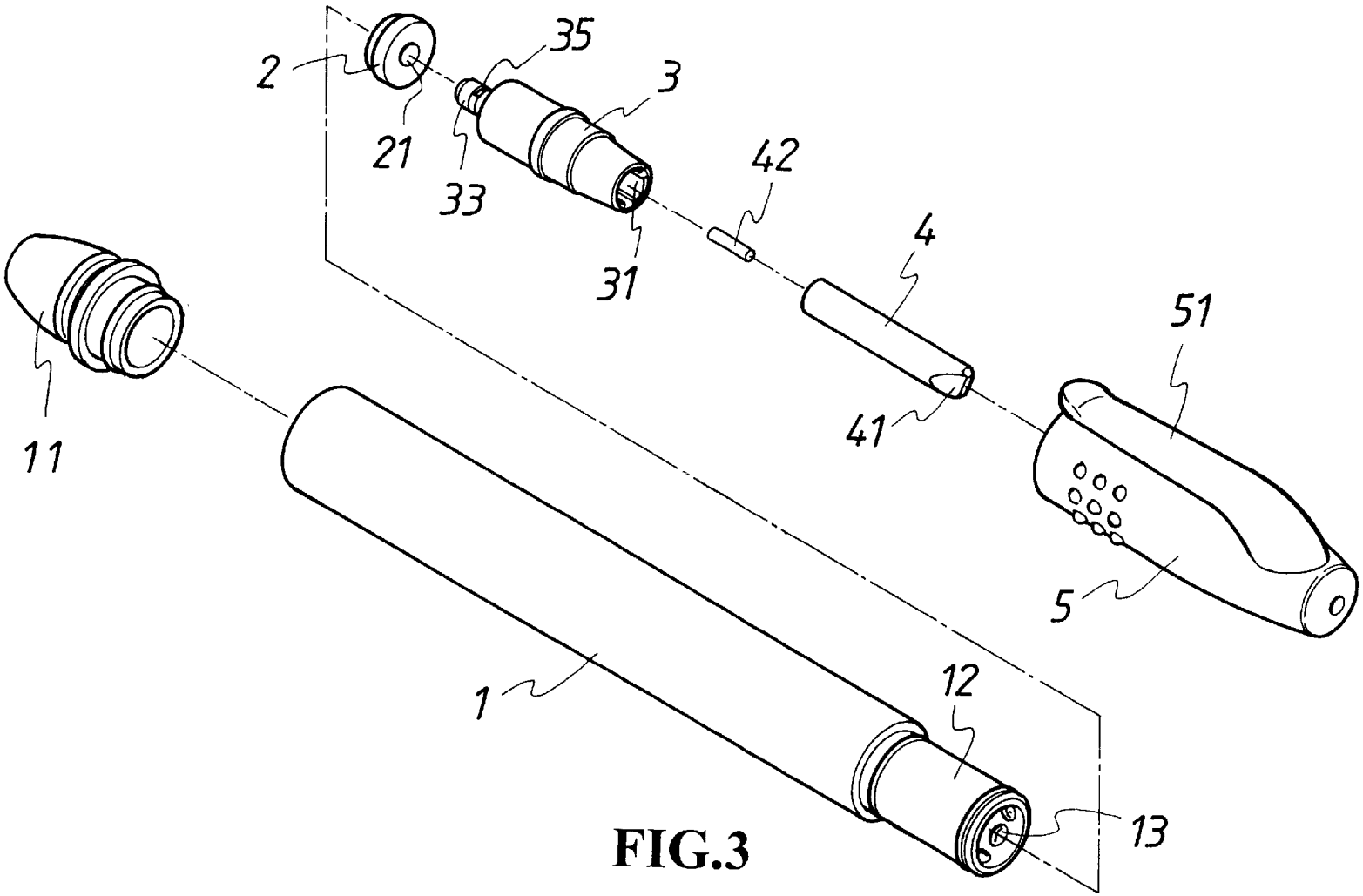
FIG. 3 is the view with all comprising parts disassembled.

As FIGS. 1, 2 and 3 illustrate, the so-called "pressure sensed ink-filled pen" design of this invention comprises at least one pen tube 1, one valve 2, one filler seat 3 and one filler 4. Also, one pen cover could be adopted so that the filler could be protected.

Among the components, the pen tube 1 is a hollow tube with one opening at one end or two openings at both ends by which one end cover 11 is clogged up at the rear end of the tube to seal up the back end opening (see FIG. 3). However, the front end of the pen tube 1 is an engaging portion 12 with a slightly smaller diameter. There is a plurality of hook-and-halt granules 13 at the front part of the inner opening of the engaging portion 12. A concave-shaped stopping piece 14 is either unitarily formed at a chosen part to the rear of the engaging portion or is installed to separate off the pen tube the stopping piece 14 has an ink outlet at the center 141. At the front of the ink outlet there is a recess with a larger diameter 142 by which the stopping piece constitute an ink reservoir in the pen tube. Moreover, the following components of the pen tube could be installed in front of the stopping piece:

The valve 2 is a U shape round mask (see FIG. 5) made of soft and elastic plastic or rubber and there is an axial via hole 21 at the center. A tapered toggle is unitary formed inside the axial via hole 21 by which a valve to control the ink flow is formed.

Figure 5:
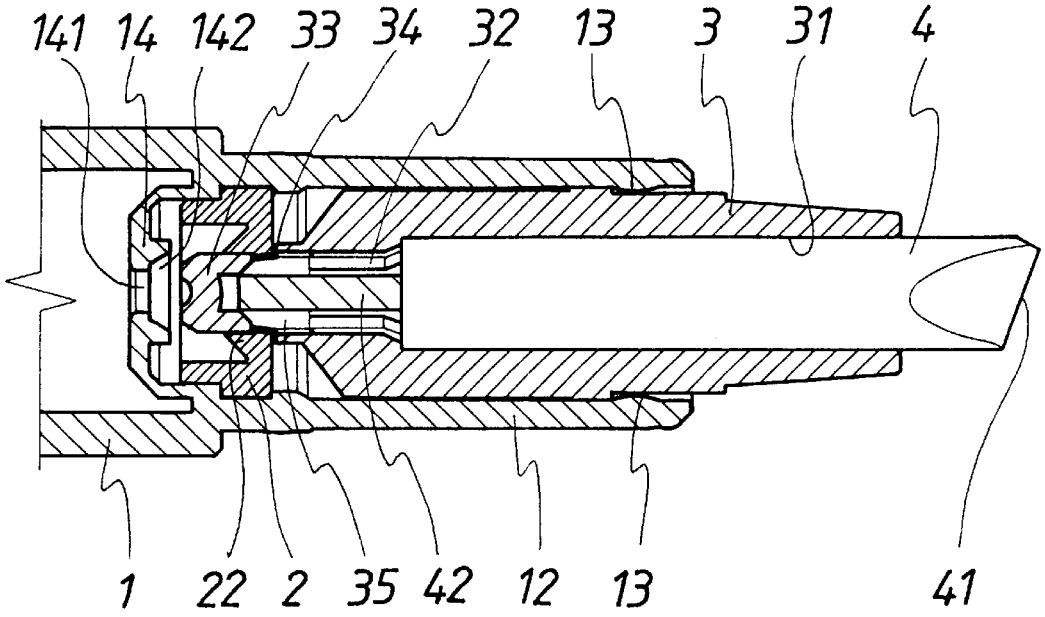
FIG. 5 illustrates the filler seat being pushed forward by said valve.
Figure 6:
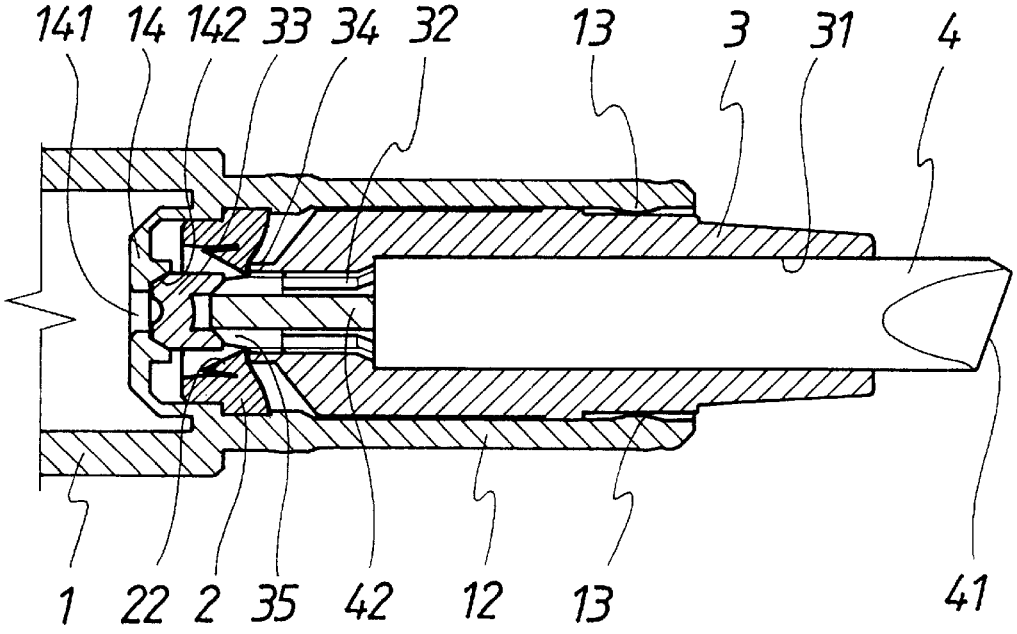
FIG. 6 illustrates said valve of said filler seat.

A filler seat 3, as shown in FIG. 5 or FIG. 6, is utilized for inserting the filler 4 and controlling a timely ink supply. It can be in the shape of a hollow cylinder. An aperture for planting filler 31 is formed in the center of the filler's front end, extending into the filler's interior. An ink guide hole 32 is formed on the base of the aperture for planting the filler 31. A top post 33 is erected on the rear end of the filler seat 3. A stepped ring 34 is formed around the root of the top post 33. One or more radial ink inlets 35 are formed around the top post 33, by which ink can flow into the filler seat 3 of the aperture for planting filler 31 through the radial ink inlets 35 and the ink guide hole 32.

Filler 4, as shown in FIG. 5 or FIG. 6, is for carrying out writing or drawing through absorbing ink. A pen nib 41 at its front end is formed into the shape of a wedge or a cone or others admitting a pointed tip. An ink absorption connecting filler 42, used for guiding ink to the front end of a filler 4, can be added at the rear end of the filler 4.

A pen cover 5 is a cylinder that covers the front end of the pen tube 1 at the engaging portion 12 for protecting the filler 4. A pen clip 51 can be installed outside the pen cover 5.

Figure 4:
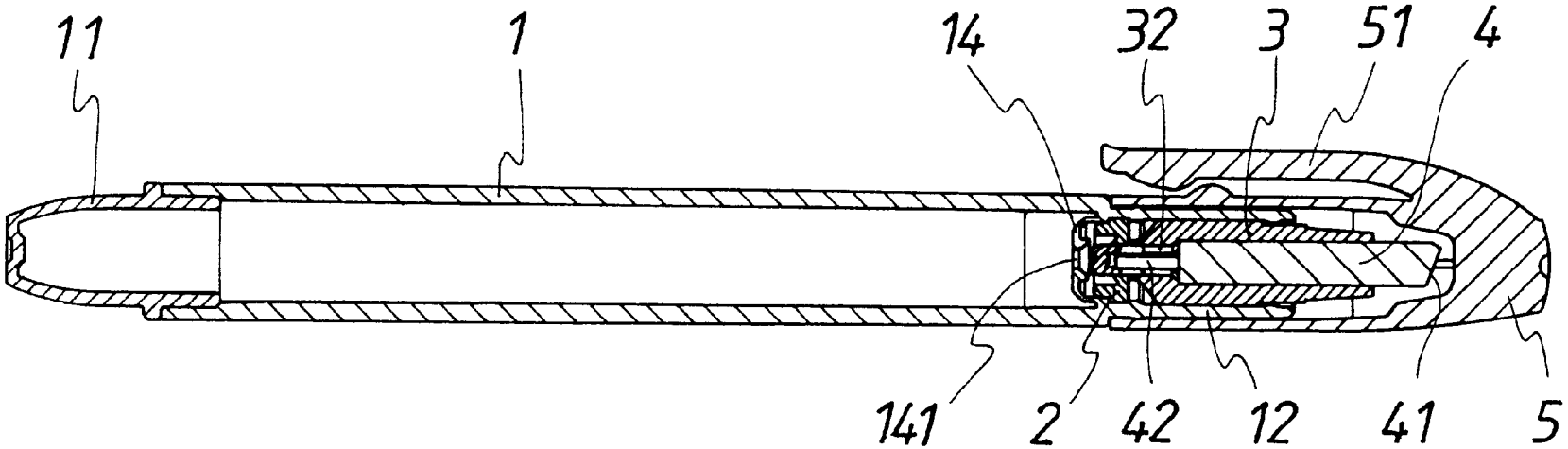
FIG. 4 is the cutaway view of the invention.

By means of the structural features of the described pen tube 1, valve 2, filler seat 3 and filler 4, as shown in FIG. 4 and FIG. 5, the U-shape valve 2 can be embedded in the front end of the pen tube 1 such that it covers the front end of the stopping piece 14. And, further, the rear end of the filler 4 is embedded in the filler-embedding hole 31 on the filler seat 3 such that the ink absorption connecting filler 42 extends to the ink guide hole 32, by which the filler seat 3 is inserted into the front end of the pen tube 1. The action of the hook-and-halt granule 13 is used to enable an axial movement. And the top post 33 at the rear end of the filler seat 3 is inserted into the axial via hole 21 on the valve 2. Applying the tight bond of the valve 2, its axial via hole 21 and the tapered toggle 22 to the ink inlet 35, the top post 33 may touch against or depart from the recess 142 and is able to push the valve 2 open, constituting the pressure-sensed ink-filled pen.

The present invention, improved in its structural design, can prevent the filled ink form evaporation and dry-out, with a further benefit of saving ink. When the pen is not in use, the spring of the valve 2 pushes the filler seat 3 forward, as shown in FIG. 5, making the top post 33 at the rear end of the filler seat 3 to depart from the recess 142 at the front end of the stopping piece 14 of the pen tube 1, by which the ink outlet 141 becomes open. That is, ink is allowed to flow from ink outlet 141 to U-shape valve 2 for temporary storage. Meanwhile, the structure of the ink inlet 35 around the closed top post 33 of the valve 2 is applied to temporarily stop ink flowing into ink guide hole 32 and being absorbing by the filler 4. Therefore, the filler 4 of the present invention does not absorb ink when it is not in use.

As the pen is in use for writing, the filler 4 is pressed against a paper such that the filler seat 3 contracts and its top post 33 props up against the recess 142 in front of the stopping piece 14 of the pen tube 1, by which the ink outlet 141 of the pen tube 1 is closed and ink ceases to flow into the valve 2. At the same time when the filler seat 3 contracts and shifts inwards, the stepped ring 34 encircling the base of the top post 33 pushes the surrounding area at the front end of axial via hole 21 of the valve 2 such that the valve 2 is slightly pressed down and accordingly the tapered toggle 22 looses the top post 33 to form a chink. In this manner, the ink temporarily stored in the valve 2 is allowed to flow through the ink inlet 35 to ink guide hole 32 such that the rear end of the filler 4 or the ink absorption connecting filler 42 can absorb ink for writing or drawing.

It is evident from the above description that the press-sensed ink-filled pen of the present invention allows the user to freely control the amount of ink flowing into the filler 4; when the user feels short of ink, he can push the filler seat 3 a few more times to acquire a proper amount of ink supply. Therefore, the present invention can effectively improve the disadvantage in wasting ink of the conventional inventions. The pressure-sensed ink-filled pen of the present invention is comprised only of the pen tube 1, the valve 2, the filler seat 3 and the filler 4. It is a further object of the present invention to reduce the manufacturing cost, given its structural simplicity. Therefore, the present invention is indeed a practical improvement from the conventional inventions.

Figure 7:
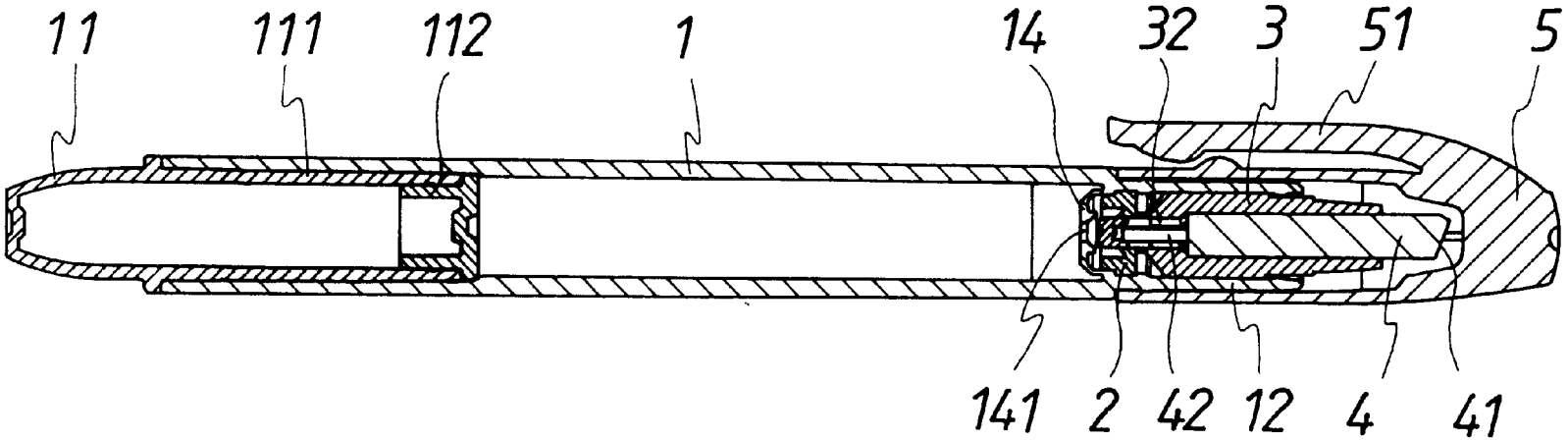
FIG. 7 illustrates another example of the end cover of this invention.

It is a further object of the present invention to properly control the amount of the ink stored in the pen tube 1. The cover of the rear end of the pen tube 1 is not restricted to a particular shape. However, it has a longer hollow inserting section 111 at its front end, as shown in FIG. 7. There is a bulged internal plug installed in the hole at the rear end of the inserting section 111, by which the inner space of the open tube 1 can be reduced. Therefore, the ink capacity in the pen tube 1 can be set to a proper amount when the pen is being manufactured.

What is claimed is:

1. A pressure-sensed ink-filled pen at least comprising:

a cylindrical pen tube having a hollow interior portion for storing liquid ink, a stopping piece being joined in a selected area at the front end of said pen tube, an ink outlet being formed at the center of said stopping piece, a valve being an U-shape round mask made of a relatively softer plastic material, an axial via hole is formed at the center of said U-shape round mask, a tapered toggle being formed surrounding the inner end side of said axial via hole, a filler seat being a tapered hollow cylinder, and a filler embedding hole is formed at the center of the front end of said filler seat and extends into the interior of said filler seat, an ink guide hole is formed at the bottom of said filler embedding hole, a top post is received at the rear end of said filler seat, ring-shape steps are formed at the base of said top post, radial ink inlets are formed around said top post, and a filler capable of absorbing liquid ink for carrying out writing;

wherein said U-shape valve is embedded at said front end of said pen tube for covering said front end of said stopping piece, said rear end of said filler is embedded within said filler inserting hole of said filler seat, said front end of said filler seat is embedded at said front end of said tube for accommodating a longitudinal movement pushing said top post at said rear end of said filler seat to insert into said via hole on said valve, said via hole of said valve and said tapered toggle are used to tightly block said ink inlets surrounding said top post, movement causing said top post at said rear end of said filler seat to lift against or depart from a depressed portion enables said tightly sealed valve to open for a inflow of liquid ink.

2. A pressure-sensed ink-filled pen according to claim 1, wherein said pen tube can be set to be a tube having an open front end, said stopping piece is received at said open front end of said open tube, and an ink outlet is formed at the center of said stopping piece.

3. A pressure-sensed ink-filled pen according to claim 1, wherein said pen tube is set to be a tube having two open ends, said stopping piece is received at said open front end of said pen tube, an ink outlet is formed at the center of said stopping piece, and a sealing cap is plugged in said pen tube to close said open rear end thereof.

4. A pressure-sensed ink-filled pen according to claim 1, wherein a covering portion of a slightly smaller diameter is formed at said front end of said pen tube, an even number of hook-and-halt granules are molded in the front section of said covering portion, and said hook-and-halt granules' holding enables said filler seat to move longitudinally.

5. A pressure-sensed ink-filled pen according to claim 1, wherein said stopping piece within said inner hole of said pen tube forms a depressed disk.

6. A pressure-sensed ink-filled pen according to claim 1, wherein a depressed section of a larger diameter is located adjacent said front end of said ink outlet, and said top post touches against said depressed section.

7. A pressure-sensed ink-filled pen according to claim 1, wherein the shape of said filler's tip is of a pointed object; for example, a chisel or a cone.

8. A pressure-sensed ink-filled pen according to claim 1, wherein an ink absorption connecting filler of smaller diameter is embedded at said rear end of said filler for guiding liquid ink to said front end thereof.

9. A pressure-sensed ink-filled pen according to claim 3, wherein a hollow inserting section of longer length is embedded at said front end of said end cover for extending into said pen tube, a bulged internal plug is inserted into the hole of said inserting section from said front end thereof.

10. A pressure-sensed ink-filled pen according to claim 1, wherein a cylindrical pen sleeve having one open end is removably receivable over said front end of said pen tube, and a pen clip is mounted on the outer surface of said pen sleeve.

* * * * *